US011697868B2

(12) United States Patent
Chen et al.

(10) Patent No.: US 11,697,868 B2
(45) Date of Patent: Jul. 11, 2023

(54) PROCESSING TECHNOLOGY FOR INHIBITING WELD COARSE GRAINS OF MAGNESIUM ALLOY PROFILES

(71) Applicant: SHANDONG UNIVERSITY, Shandong (CN)

(72) Inventors: Liang Chen, Shandong (CN); Jianwei Tang, Shandong (CN); Zhigang Li, Shandong (CN); Guoqun Zhao, Shandong (CN); Cunsheng Zhang, Shandong (CN)

(73) Assignee: SHANDONG UNIVERSITY, Shandon (CN)

( * ) Notice: Subject to any disclaimer, the term of this patent is extended or adjusted under 35 U.S.C. 154(b) by 0 days.

(21) Appl. No.: 17/844,065

(22) Filed: Jun. 20, 2022

(65) Prior Publication Data

US 2023/0117724 A1 Apr. 20, 2023

(30) Foreign Application Priority Data

Oct. 14, 2021 (CN) ..... 202111197811.1

(51) Int. Cl.
*C22F 1/06* (2006.01)
*C22F 1/00* (2006.01)

(52) U.S. Cl.
CPC ..... *C22F 1/06* (2013.01); *C22F 1/002* (2013.01)

(58) Field of Classification Search
CPC ..... C22F 1/06; C22F 1/002
See application file for complete search history.

(56) References Cited

FOREIGN PATENT DOCUMENTS

| | | | | |
|---|---|---|---|---|
| CN | 109136506 A | * | 1/2019 | ..... B21C 23/00 |
| CN | 107675034 | | 3/2019 | |
| CN | 110004341 A | * | 7/2019 | ..... B21C 29/003 |
| CN | 109161828 | | 3/2021 | |

OTHER PUBLICATIONS

Zhang et al., Improved formability of Mg—3Al—1Zn alloy by pre-stretching and annealing, Scripta Materialia 67 (2012) 495-498 (Year :2012).*

Chaudry et al., A Further Improvement in the Room-Temperature Formability of Magnesium Alloy Sheets by Pre-Stretching, Materials 2020, 13, 2633, pp. 1-12 (Year: 2020).*

* cited by examiner

*Primary Examiner* — Rebecca Janssen
(74) *Attorney, Agent, or Firm* — JCIPRNET

(57) ABSTRACT

Disclosed is a processing technology for inhibiting weld coarse grains of magnesium alloy profiles, including the following steps: preparation of a magnesium alloy ingot, homogenization, scalping, extrusion, pre-stretching at room temperature, solution treatment, quenching, stretching correction, artificial aging, etc. The processing technology can effectively control the production of weld coarse grains in extrusion and heat treatment processes of magnesium alloy profiles, and all property indexes of final products are higher than standard requirements.

4 Claims, 2 Drawing Sheets

PROCESSING TECHNOLOGY FOR INHIBITING WELD COARSE GRAINS OF MAGNESIUM ALLOY PROFILES

CROSS-REFERENCE TO RELATED APPLICATION

This application claims the priority benefit of China application serial no. 202111197811.1, filed on Oct. 14, 2021. The entirety of the above-mentioned patent application is hereby incorporated by reference herein and made a part of this specification.

BACKGROUND

Technical Field

The present invention belongs to the field of processing and heat treatment of magnesium alloys, and particularly relates to a method for controlling weld coarse grains in extrusion and heat treatment processes of magnesium alloy profiles.

Description of Related Art

The magnesium alloy, as the lightest structural metal material in current engineering applications, has the advantages of high specific strength and specific stiffness, and excellent thermal conductivity, damping and shock absorption, electromagnetic shielding and machining properties. Today, with increasing emphasis on sustainable development, the magnesium alloy is gradually becoming the most promising lightweight structural material in the fields of aerospace, national defense and military industry, track traffic, etc. However, the magnesium alloy has a close-packed hexagonal structure, and the plastic processing ability of the magnesium alloy is poor, which increases the difficulty of forming magnesium alloy components. In addition, the lower absolute strength of the magnesium alloy also limits the application and development of the magnesium alloy in actual production.

An extruded profile is one of the main forms of the magnesium alloy in engineering applications. On the one hand, a three-dimensional compressive stress state during extrusion can maximize the plasticity of the magnesium alloy. On the other hand, an extrusion technology is more flexible, has higher production efficiency, and can produce various plates, pipes, bars and complex cross-section profiles with high dimensional accuracy and good surface quality. Through the synergistic effect of extrusion deformation and heat treatment, the component uniformity and microstructure of the magnesium alloy are improved, and magnesium alloy profiles with high strength, good elongation and various sizes can be obtained so as to meet the mechanical properties and size requirements of various structural parts. In addition, after extrusion, heat treatment technologies (annealing, solution treatment and aging) can not only enhance the strength and elongation at break of the profiles, but also greatly improve the corrosion resistance of the magnesium alloy profiles. With the expansion of application fields of the magnesium alloy, the demand for magnesium alloy profiles is increasing, and property requirements are also getting higher and higher. Therefore, the research and development and preparation of high-strength and corrosion-resistant magnesium alloy profiles have gradually become the current research problems and hotspots.

During the extrusion of a divergent die of magnesium alloy profiles, the severe friction between a blank and a divergent bridge as well as an inner wall of a die cavity makes profile weld and surface layer metal grains accumulate higher distortion energy inside and between grains, and a coarse grain structure is prone to appear during extrusion and subsequent heat treatment, which is also an important structural defect of magnesium alloy profiles. The appearance of the coarse grain structure will greatly deteriorate the mechanical properties and machining properties of magnesium alloy profiles, reduce the qualification rate of profiles, and greatly increase the production cost. At present, researchers at home and abroad have carried out a lot of work on surface coarse grains of aluminum alloy profiles, and proposed measures of optimizing alloy components, regulating extrusion and heat treatment processes, etc. to reduce and eliminate surface coarse grain defects. In the invention patent with an authorization announcement number of CN107675034B, a deformed aluminum alloy for improving coarse grains of extruded profiles is disclosed. In the present invention, by adding alloy elements such as Mn, Cr and Zr, the occurrence of recrystallization is inhibited, and deformed structures are retained, so that the thickness of a coarse grain layer of the extruded profile is not greater than 0.15 mm which reaches the level of the thickness of a micro-coarse grain ring. In the invention patent with an authorization announcement number of CN109161828B, a processing technology for reducing surface coarse grains of aluminum alloy profiles in a T5 state, and an aluminum alloy profile are disclosed. Through reasonable die design (work tape length) and reasonable extrusion quenching technology (extrusion temperature, extrusion speed and online quenching), the method eliminates the coarse grain structure on the surface of the profile and ensures the product properties. It can be seen that the existing research is mainly aimed at aluminum alloy profiles, and the occurrence of recrystallization and grain growth is inhibited by adjusting components and technologies, thereby reducing or eliminating the coarse grain structure on the surface. However, as a metal with low stacking fault energy, the magnesium alloy has completely different physical and chemical properties from that of the aluminum alloy, and is very prone to complete recrystallization. Therefore, it is difficult to control the recrystallization of the magnesium alloy by adding alloy elements to eliminate the coarse grain structure of the magnesium alloy profile. Secondly, the production of coarse grains in the extrusion process can be inhibited by technology adjustment, but the effect on the production of coarse grains in the heat treatment process is not obvious. In addition, most of the current studies are carried out on surface coarse grains, and there are few studies on weld coarse grains. Therefore, there is an urgent need to develop an effective method for controlling the production of weld coarse grains in extrusion and heat treatment processes of magnesium alloy profiles.

SUMMARY

Based on the above, an objective of the present invention is to provide a processing technology for inhibiting weld coarse grains of magnesium alloy profiles. The processing technology can effectively control the production of weld coarse grains in extrusion and heat treatment processes of magnesium alloy profiles, the physical properties such as hardness and strength of final products are greatly enhanced, and the bearing capacity, use safety and service life are significantly improved.

To achieve the foregoing technical objective, the present invention adopts the following technical solutions:

A processing technology for inhibiting weld coarse grains of magnesium alloy profiles includes the following steps:

(1) preparing a magnesium alloy ingot, wherein a size of the ingot needs to be selected according to an extruder used;

(2) homogenizing the magnesium alloy ingot;

(3) scalping the magnesium alloy ingot obtained in step (2);

(4) extruding the magnesium alloy ingot obtained in step (3) to obtain a magnesium alloy extruded profile, and at the same time, cooling an extrusion die by using liquid nitrogen during extrusion;

(5) pre-stretching the extruded profile obtained in step (4) at room temperature;

(6) performing solution treatment on the magnesium alloy profile pre-stretched in step (5), and quenching the magnesium alloy profile after the solution treatment is completed;

(7) performing stretching correction on the magnesium alloy profile after the solution treatment in step (6); and (8) artificially aging the profile obtained in step (7).

Further, a size of the ingot is Φ120×400 mm.

Further, a temperature of the homogenization is 380-410° C., and a holding time is 10-24 h.

Further, during the scalping, a processing amount of a surface layer is 1-6 mm, and a surface roughness Ra is less than or equal to 23 μm.

Further, in step (4), a temperature of a cast rod is 250-350° C., a temperature of the die is 280-380° C., a temperature of an extrusion cylinder is 260-360° C., and an extrusion speed is 0.5-5 mm/s.

Further, in step (4), an outlet pressure of the liquid nitrogen is 0.5-0.6 MPa.

Further, in step (5), a stretching deformation rate of the pre-stretching at room temperature is 10-20%.

Further, in step (6), a solution treatment temperature is 380-420° C., and a solution treatment time is 1-3 h.

Further, in step (7), a stretching deformation rate of the stretching correction is 0.5-1.5%.

Further, in step (8), an aging temperature is 98-225° C., and an aging time is 12-144 h.

An appropriate homogenization technology can eliminate component segregation and coarse second-phase particles in the magnesium alloy ingot, improve the degree of homogenization of structures and components, and enhance the extrusion properties of magnesium alloys. If the homogenization temperature is too low and the homogenization time is too short, the undissolved coarse second-phase particles in the magnesium alloy ingot are not conducive to the development of an extrusion technology and will reduce the service properties of the extruded profile. If the homogenization temperature is too high, defects such as overburning and coarse grains are likely to occur.

The scalping can effectively remove oxides and other impurities on the surface of the ingot, thereby improving the welding quality and comprehensive properties of the magnesium alloy profile.

By reducing the temperatures of a blank, the extrusion cylinder and the extrusion die and forming a liquid nitrogen cooling channel at an outlet of the die, the temperature at an extrusion outlet of the magnesium alloy profile is reduced. On the one hand, the reduction of the outlet temperature of the die can inhibit the abnormal growth of weld grains in the extrusion process of the magnesium alloy profile. On the other hand, without producing weld coarse grains and hot cracks on the surface of the profile, the extrusion speed of the magnesium alloy profile can be greatly increased, and the production efficiency can be effectively increased.

By adding the pre-stretching treatment at room temperature before the solution treatment and after the extrusion, the deformation stored energy distribution, texture type and strength of the grains in weld zones of the magnesium alloy profile are adjusted, and an appropriate solution treatment technology is used for thoroughly avoiding the production of weld coarse grains in the heat treatment process, thereby realizing the complete elimination of the weld coarse grains in the overall processes of extrusion and heat treatment of the magnesium alloy profile, and greatly improving the comprehensive mechanical properties of the magnesium alloy profile. The study found that when the pre-stretching deformation rate is less than 5%, the refining degree of the grains in the weld zones after the solution treatment is not high. In addition, static recrystallization and grain growth occur in matrix zones, and the recrystallization degree of grains and grain sizes are increased to different degrees. Therefore, the above two points also lead to the reduction of the mechanical properties of the profile of which the pre-stretching deformation rate is less than 5%. When the pre-stretching deformation rate is 10%-20%, the refining degree of the grains in the weld zones after the solution treatment is obvious. With the increase of the pre-stretching deformation rate, the refining degree of the grains in the weld zones after the solution treatment is gradually increased, and the strength of the profile is also increased. When the pre-stretching deformation rate is greater than 25%, the stretching deformation exceeds the deformation limit of the extruded profile, and thus, the profile fails. Therefore, the pre-stretching deformation rate in the present invention needs to be 10%-20%.

By stretching correction pre-deformation before the artificial aging, the deformation stored energy generated by the pre-deformation can significantly accelerate a phase transformation process, and this precipitation phenomenon is referred to as strain-induced precipitation. Since the second phase of the strain-induced precipitation can be precipitated in a relatively short time and the particle sizes of the obtained second phase are obviously refined, there will be some beneficial effects (such as obvious interaction with the recrystallization of matrix structures, control of the grain growth of recrystallized structures, obvious strain-induced precipitation strengthening effect, etc.). Secondly, the pre-deformation introduces a high density of dislocations and twins so as to provide heterogeneous nucleation sites for precipitated phases, and dense dislocations can also act as a channel for rapid diffusion of solute elements, thereby increasing the precipitated phases and accelerating the precipitation speed. The reasonable temperature and time ranges of the artificial aging are determined by the differential scanning calorimetry and the existing research. Then a series of heat treatment is performed on the profile. The optimal aging temperature and time are determined in combination with a hardness test and a stretching test. The extruded magnesium alloy profile is processed in the order of solution treatment, stretching correction and artificial aging, thereby enhancing the aging effect of the profile, shortening the aging time, greatly improving the comprehensive properties of the profile, and increasing the production efficiency.

Beneficial Effects of the Present Invention (1) In the present invention, an appropriate homogenization technology is used for eliminating component segregation and coarse second-phase particles in the magnesium alloy ingot, improving the degree of homogenization of structures and components, and enhancing the extrusion properties of magnesium alloys.

(2) In the present invention, the magnesium alloy ingot is scalped to effectively remove oxides and other impurities on the surface of the ingot, thereby improving the welding quality and comprehensive properties of the magnesium alloy profile.

(3) In the present invention, the abnormal growth of weld grains in the extrusion process of the magnesium alloy profile is inhibited by reducing the temperature at the extrusion outlet of the magnesium alloy profile; and without producing weld coarse grains and hot cracks on the surface of the profile, the extrusion speed of the magnesium alloy profile can be greatly increased, and the production efficiency can be effectively increased.

(4) In the present invention, by adding the pre-stretching treatment at room temperature before the solution treatment and after the extrusion, the deformation stored energy distribution, texture type and strength of the grains in weld zones of the magnesium alloy profile are adjusted, and an appropriate solution treatment technology is used for thoroughly avoiding the production of weld coarse grains in the heat treatment process, thereby realizing the complete elimination of the weld coarse grains in the overall processes of extrusion and heat treatment of the magnesium alloy profile, and greatly improving the comprehensive mechanical properties of the magnesium alloy profile.

(5) In the present invention, the solution treatment, the stretching correction and the artificial aging are combined, and an appropriate amount of dislocations are introduced, thereby enhancing the aging effect of the profile, shortening the aging time, greatly improving the comprehensive properties of the profile, and increasing the production efficiency.

BRIEF DESCRIPTION OF THE DRAWINGS

The accompanying drawings that form a part of the present invention are used to provide further understanding of the present invention, and the exemplary embodiments and descriptions of the present invention are used to explain the present invention and do not constitute improper limitations on the present invention.

DESCRIPTION OF THE EMBODIMENTS

The present invention is described in detail below with reference to specific embodiments.

Figure 1:
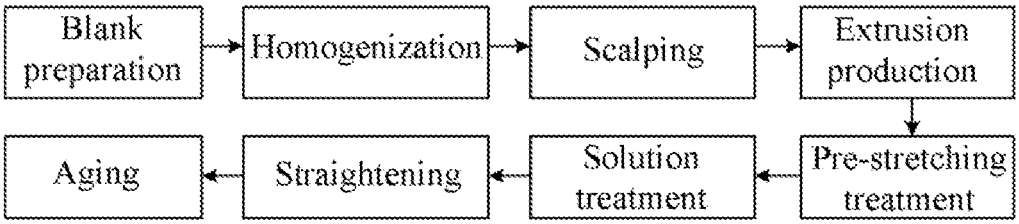
FIG. 1 is a flow chart of a technological method of the present invention.
Figure 2:
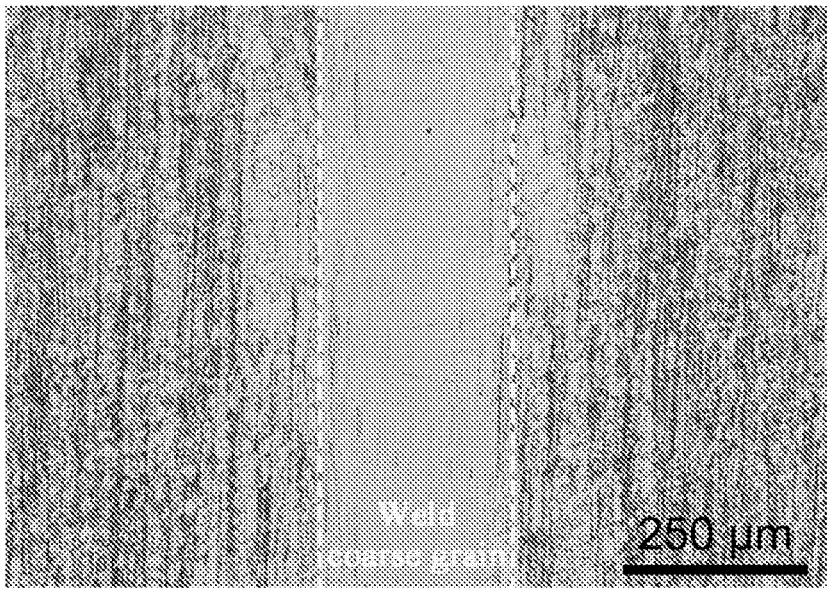
FIG. 2 is a photograph of part of the grain structure in a weld zone of a magnesium alloy profile when no pre-stretching treatment is performed.
Figure 3:
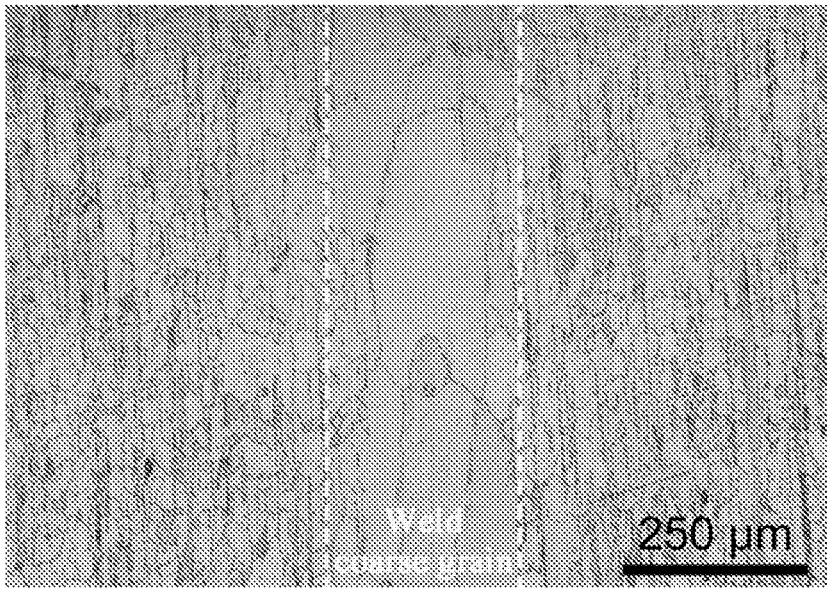
FIG. 3 is a photograph of part of the grain structure in a weld zone of a magnesium alloy profile when 5% pre-stretching treatment is performed.
Figure 4:
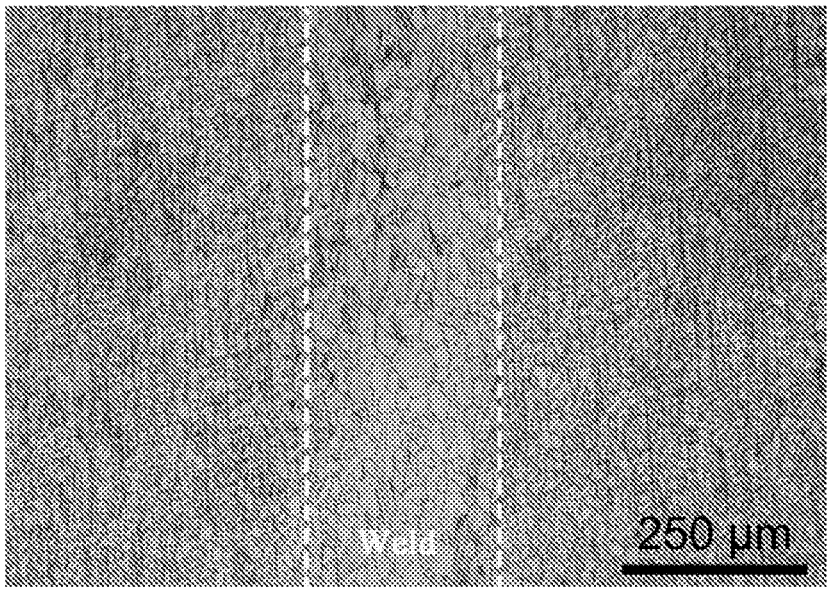
FIG. 4 is a photograph of part of the grain structure in a weld zone of a magnesium alloy profile when 10% pre-stretching treatment is performed.
Figure 5:
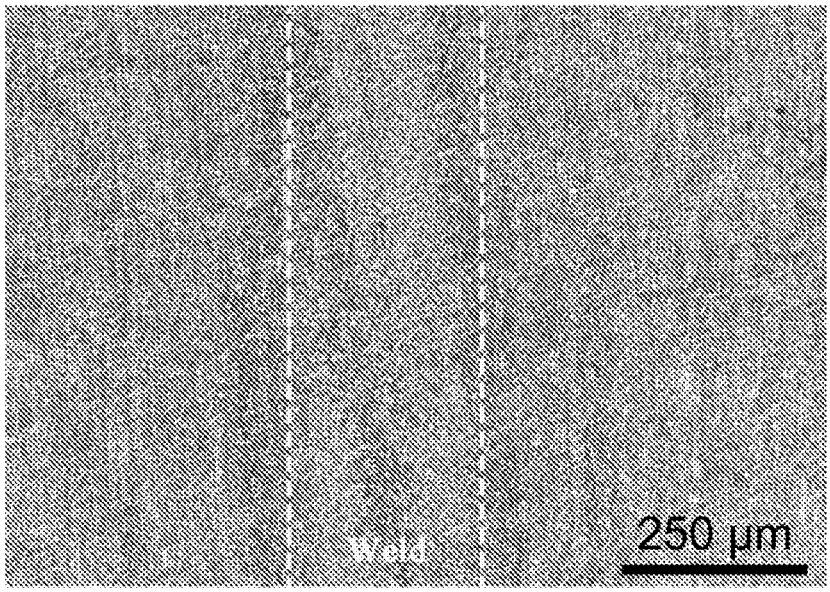
FIG. 5 is a photograph of part of the grain structure in a weld zone of a magnesium alloy profile when 20% pre-stretching treatment is performed.

The present invention provides a processing technology for inhibiting weld coarse grains of magnesium alloy profiles. Specific technological processes are shown in FIG. 1. Specific implementations are as follows:

Embodiment 1

A processing technology for inhibiting weld coarse grains of magnesium alloy profiles included the following specific steps:

(1) An ordinary commercial ZK60 magnesium alloy ingot was prepared, wherein the size of the ingot was Φ120×400 mm.

(2) The magnesium alloy ingot was homogenized at 410° C., wherein a holding time was 24 h.

(3) The magnesium alloy ingot obtained in step (2) was scalped. During the scalping, a processing amount of a surface layer was 1 mm, and a surface roughness Ra was less than or equal to 23 μm.

(4) The magnesium alloy ingot obtained in step (3) was extruded to obtain a magnesium alloy extruded profile, wherein a temperature of a cast rod was 350° C., a temperature of a die was 380° C., a temperature of an extrusion cylinder was 360° C., and an extrusion speed was 5 mm/s. In addition, during the extrusion, an extrusion die was cooled by using liquid nitrogen, and an outlet pressure of the liquid nitrogen was 0.5 MPa.

(5) The extruded profile obtained in step (4) was pre-stretched at room temperature, wherein a stretching deformation rate was 10%.

(6) Solution treatment was performed on the magnesium alloy profile pre-stretched in step (5) at 420° C. for 1 h. Quenching was performed after the solution treatment was completed.

(7) Stretching correction was performed on the magnesium alloy profile after the solution treatment in step (6), wherein a stretching deformation rate was 1.5%.

(8) The profile obtained in step (7) was artificially aged at 225° C. for 12 h.

The tensile strength, yield strength, elongation at break and weld zone hardness of the magnesium alloy profile obtained in Embodiment 1 were 278 MPa, 224 MPa, 0.13 and 59 HV respectively.

Embodiment 2

A processing technology for inhibiting weld coarse grains of magnesium alloy profiles included the following specific steps:

(1) An ordinary commercial ZK60 magnesium alloy ingot was prepared, wherein the size of the ingot was Φ120×400 mm.

(2) The magnesium alloy ingot was homogenized at 380° C., wherein a holding time was 24 h.

(3) The magnesium alloy ingot obtained in step (2) was scalped. During the scalping, a processing amount of a surface layer was 6 mm, and a surface roughness Ra was less than or equal to 23 μm.

(4) The magnesium alloy ingot obtained in step (3) was extruded to obtain a magnesium alloy extruded profile, wherein a temperature of a cast rod was 250° C., a temperature of a die was 280° C., a temperature of an extrusion cylinder was 260° C., and an extrusion speed was 0.5 mm/s. In addition, during the extrusion, an extrusion die is cooled by using liquid nitrogen, and an outlet pressure of the liquid nitrogen was 0.6 MPa.

(5) The extruded profile obtained in step (4) was pre-stretched at room temperature, wherein a stretching deformation rate was 20%.

(6) Solution treatment was performed on the magnesium alloy profile pre-stretched in step (5) at 380° C. for 3 h. Quenching was performed after the solution treatment was completed.

(7) Stretching correction was performed on the magnesium alloy profile after the solution treatment in step (6), wherein a stretching deformation rate was 0.5%.

(8) The profile obtained in step (7) was artificially aged at 98° C. for 144 h.

The tensile strength, yield strength, elongation at break and weld zone hardness of the magnesium alloy profile obtained in Embodiment 2 were 335 MPa, 276 MPa, 0.18 and 72 HV respectively.

Embodiment 3

A processing technology for inhibiting weld coarse grains of magnesium alloy profiles included the following specific steps:

(1) An ordinary commercial ZK60 magnesium alloy ingot was prepared, wherein the size of the ingot was Φ120×400 mm.

(2) The magnesium alloy ingot was homogenized at 400° C., wherein a holding time was 20 h.

(3) The magnesium alloy ingot obtained in step (2) was scalped. During the scalping, a processing amount of a surface layer was 4 mm, and a surface roughness Ra was less than or equal to 23 μm.

(4) The magnesium alloy ingot obtained in step (3) was extruded to obtain a magnesium alloy extruded profile, wherein a temperature of a cast rod was 300° C., a temperature of a die was 320° C., a temperature of an extrusion cylinder was 300° C., and an extrusion speed was 2 mm/s. In addition, during the extrusion, an extrusion die is cooled by using liquid nitrogen, and an outlet pressure of the liquid nitrogen was 0.6 MPa.

(5) The extruded profile obtained in step (4) was pre-stretched at room temperature, wherein a stretching deformation rate was 15%.

(6) Solution treatment was performed on the magnesium alloy profile pre-stretched in step (5) at 380° C. for 3 h. Quenching was performed after the solution treatment was completed.

(7) Stretching correction was performed on the magnesium alloy profile after the solution treatment in step (6), wherein a stretching deformation rate was 1.0%.

(8) The profile obtained in step (7) was artificially aged at 200° C. for 20 h.

The tensile strength, yield strength, elongation at break and weld zone hardness of the magnesium alloy profile obtained in Embodiment 3 were 308 MPa, 241 MPa, 0.15 and 65 HV respectively.

Magnesium alloy profiles treated according to the above processing technology for inhibiting weld coarse grains of magnesium alloy profiles are different in that no pre-stretching treatment is performed on the magnesium alloy profile (1), 5% pre-stretching treatment is performed on the magnesium alloy profile (2), 10% pre-stretching treatment is performed on the magnesium alloy profile (3), and 20% pre-stretching treatment is performed on the magnesium alloy profile (4). After solution treatment (temperature: 400° C., time: 1 h) is performed on the above four magnesium alloy profiles, photographs of part of the grain structure in weld zones of the magnesium alloy profiles are studied. As shown in FIG. 2, FIG. 3, FIG. 4 and FIG. 5, the grain size of a weld zone of the magnesium alloy profile (1) is about 250 μm, and a matrix zone is also composed of recrystallized grains with a grain size of about 20 μm and elongated deformed grains; the grain size of a weld zone of the magnesium alloy profile (2) is about 200 μm, and a matrix zone is also composed of recrystallized grains with a grain size of about 80 μm; the grain size of a weld zone of the magnesium alloy profile (3) is about 30 μm, and a matrix zone is also composed of recrystallized grains with a grain size of about 20 μm; and the grain size of a weld zone of the magnesium alloy profile (4) is about 9 μm, and a matrix zone is also composed of recrystallized grains with a grain size of about 10 μm. It can be seen that the pre-stretching treatment has a great influence on the coarse grains in the weld zone of the magnesium alloy profile. By the pre-stretching treatment at room temperature, the deformation stored energy distribution, texture type and strength of the grains in the weld zone of the magnesium alloy profile are adjusted. Through comparative experiments, it can be seen that when the pre-stretching deformation rate is 10%-20%, the refining degree of the grains in the weld zone after the solution treatment is obvious. With the increase of the pre-stretching deformation rate, the refining degree of the grains in the weld zone after the solution treatment is gradually increased.

What is claimed is:

1. A processing technology for inhibiting weld coarse grains of magnesium alloy profiles, comprising the following steps:

(1) preparing a magnesium alloy ingot, wherein a size of the ingot needs to be selected according to an extruder used;

(2) homogenizing the magnesium alloy ingot;

(3) scalping the magnesium alloy ingot obtained in step (2);

(4) extruding the magnesium alloy ingot obtained in step (3) to obtain a magnesium alloy extruded profile, and at the same time, cooling an extrusion die by using liquid nitrogen during extrusion;

(5) pre-stretching the extruded profile obtained in step (4) at room temperature;

(6) performing solution treatment on the magnesium alloy profile pre-stretched in step (5), and quenching the magnesium alloy profile after the solution treatment is completed;

(7) performing stretching correction on the magnesium alloy profile after the solution treatment in step (6); and (8) artificially aging the profile obtained in step (7), wherein in step (5), a pre-stretching deformation at room temperature is 10-20%, in step (4), a temperature of the magnesium alloy ingot is 250-350° C., a temperature of the die is 280-380° C., a temperature of an extrusion cylinder is 260-360° C., an extrusion speed is 0.5-5 mm/s, and an outlet pressure of the liquid nitrogen is 0.5-0.6 MPa, in step (6), a solution treatment temperature is 380-420° C., and a solution treatment time is 1-3 h, in step (7), a stretching deformation of the stretching correction is 0.5-1.5%, in step (8), an aging temperature is 98-225° C., and an aging time is 12-144 h.

2. The processing technology for inhibiting weld coarse grains of magnesium alloy profiles according to claim 1, wherein the size of the ingot is Φ120×400 mm.

3. The processing technology for inhibiting weld coarse grains of magnesium alloy profiles according to claim 1, wherein the temperature of the homogenization is 380-410° C., and a holding time is 10-24 h.

4. The processing technology for inhibiting weld coarse grains of magnesium alloy profiles according to claim 1, wherein during the scalping, a processing amount of a surface layer is 1-6 mm, and a surface roughness Ra is less than or equal to 23 μm.

* * * * *